US006782554B1

(12) United States Patent
Froehlich

(10) Patent No.: US 6,782,554 B1
(45) Date of Patent: Aug. 31, 2004

(54) APPAREL-RELATED ENTERTAINMENT SYSTEM

(76) Inventor: Susan Froehlich, 408 Daroco Ave., Coral Gables, FL (US) 33146

( * ) Notice: Subject to any disclaimer, the term of this patent is extended or adjusted under 35 U.S.C. 154(b) by 0 days.

(21) Appl. No.: 10/464,472

(22) Filed: Jun. 19, 2003

(51) Int. Cl.[7] ..... A41B 1/00
(52) U.S. Cl. ..... 2/69; 2/115; 2/244
(58) Field of Search ..... 2/69, 108, 115, 2/105, 106, 244, 246, 1; 40/586; 434/395–400

(56) References Cited

U.S. PATENT DOCUMENTS 3,484,974 A * 12/1969 Culmone ..... 40/586
4,249,268 A * 2/1981 Berler ..... 2/115
4,627,110 A * 12/1986 Tengs ..... 2/69
4,710,981 A * 12/1987 Sanchez ..... 2/115
4,991,233 A * 2/1991 Hall ..... 2/115
4,999,848 A * 3/1991 Oney ..... 2/115
5,394,565 A * 3/1995 Stewart et al. ..... 2/69
5,398,343 A * 3/1995 Kuracina ..... 2/115
5,718,589 A * 2/1998 McCracken et al. ..... 434/159
5,943,697 A * 8/1999 Poskanzer ..... 2/69
6,161,959 A * 12/2000 Abraham ..... 383/97

* cited by examiner

*Primary Examiner*—Gloria M. Hale
(74) *Attorney, Agent, or Firm*—Melvin K. Silverman

(57) ABSTRACT

An apparel-related entertainment system includes an article of clothing having pre-printed thereon a first indicia that is a sentence segment including a noun, a verb, and a preposition and, therebeneath, a strip of hook-and-pile material. The system further includes a packet of letters of the alphabet, each provided on surfaces having a backing of a hook-and-pile material, each of the surface proportioned for press-fittable placement upon and within the strip on the article of clothing to, when positioned upon the strip, form a second indicia that is an object or object phrase of the preposition to complete a sentence including the sentence fragment of the first indicia.

6 Claims, 6 Drawing Sheets

APPAREL-RELATED ENTERTAINMENT SYSTEM

BACKGROUND OF THE INVENTION

A. Area of Invention

The present invention relates to novelty garments bearing indicia and using hook and pile surfaces.

B. Prior Art

Garments of the type containing selectably removable and replaceable identifying characters or indicia are known in the art as, particularly, are represented by U.S. Pat. No. 3,484,974 (1969) to Culmone, entitled Removable Identifying Characters For Clothing; U.S. Pat. No. 4,991,233 (1991) to Hall, entitled Garment With Indicia; U.S. Pat. Des. No. 333,030 (1993) to Wilkes, entitled Garment Attachable Patch; and U.S. Pat. No. 5,379,461 (1995) to Wilmers, entitled Interactive Clothing With Indicia And Cover Panel.

A product bearing substantially similarity in concept to Culmone, above, is sold by the Alpha-T Company in the United Kingdom as what is known as the Alpha.T Shirt. Therein, is provided a hook-and-pile chest panel and hook-and-pile backed letters and numerals with which to write one's own slogans, messages or explicitives, and to broadcast them to an unsuspecting public or "a special someone" according to on-line advertising of Alpha.T (see www.wannit.co.uk/acatalog/online-catalog-Alpha-T-Shirt). The Alpha.T shirt is usable and the letters or terms thereon can be changed as frequently as changes in one's mood. However, as above noted, the Alpha.T shirt is technically similar, if not identical, to the 1969 teaching of Culmone above.

Wilkes represents a simple enhancement of the concept of Culmone in that an entire patch is provided to a garment wherein the patch itself is provided with hook-and-pile means onto which word or phrase containing strips are adhered.

The above patents to Hall and Wilmers employ the use of fixed indicia which are permanently printed upon the shirt or garment, and a second indicia which is normally hidden from view. In the context of an interactive game, a second party must then attempt to guess the content thereof. The present invention, while employing a first indicia, as is more particularly described below, also employs a second indicia although not one which is pre-established and which is to be revealed by a player of a "game" associated with such interactive clothing. Rather, the present invention represents a means by which a user thereof, or one acting with the approval of the user, may express one's mood however, not generally as in the case of Colmone or the Alpha T shirt but, rather, as the object of a sentence fragment ending with a preposition, such that the message thereby projected by the user of wearer of the garment, or one acting with the approval thereof, is far more focused and particular, than is the case with the shirt of Culmone or the Alpha T shirt, since the selectably second indicia thereof is the object of a preposition of a particular sentence, as opposed to a disembodied noun, verb, or explicitive as is the case in the Alpha T shirt. Further, because of the prepositional sentence which precedes the object phrase of the selectable second indicia, a second party, acting with the consent of the wearer, may express his or her opinion with regard to what the appropriate object of the sentence object phrase should be in a given circumstance and given relationship which may exist between a party of the first part (the wearer of the garment) and a party of the second part, i.e., one wishing to become "interactive" with the party of the first part.

For the above reasons, the present invention addresses a long-felt need in the area of garments having removable identifying characters or phrases.

SUMMARY OF THE INVENTION

The instant invention pertains to an apparel-related entertainment system comprising an article of clothing having pre-printed thereon a first indicia comprising a sentence segment including a noun, a verb, and a preposition and, therebeneath, a strip of hook-and-pile material. The system further includes a packet of letters of the alphabet, each provided on surfaces having a backing comprising a hook-and-pile material, each of said surface is proportioned for press-fittable placement upon and within said strip on said article of clothing to, when positioned upon said strip, form a second indicia comprising an object or object phrase of said preposition to thereby complete a sentence including said sentence fragment of said first indicia.

It is accordingly an object of the present invention to provide an interactive apparel-related entertainment system in which a mood or feeling of the wearer of the apparel or one acting with the consent thereof may complete an object of a prepositional sentence and, thereby, express one's mood or feeling at that time with regard to any given subject.

It is another object to provide a garment with fixed and non-fixed categories of indicia thereupon to effectively enable selectively different slogans, messages and the like to be communicated interactively with others within a party or entertainment setting.

It is another object of the invention to provide a form of novelty clothing which may be used to facilitate the physical contact between a wearer thereof and a second party participating in the interactive use of an indicia associated with such a garment.

It is a further object to provide an interactive apparel system of the above type which may be used at sporting or athletic events to express preferences or information with respect thereto.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
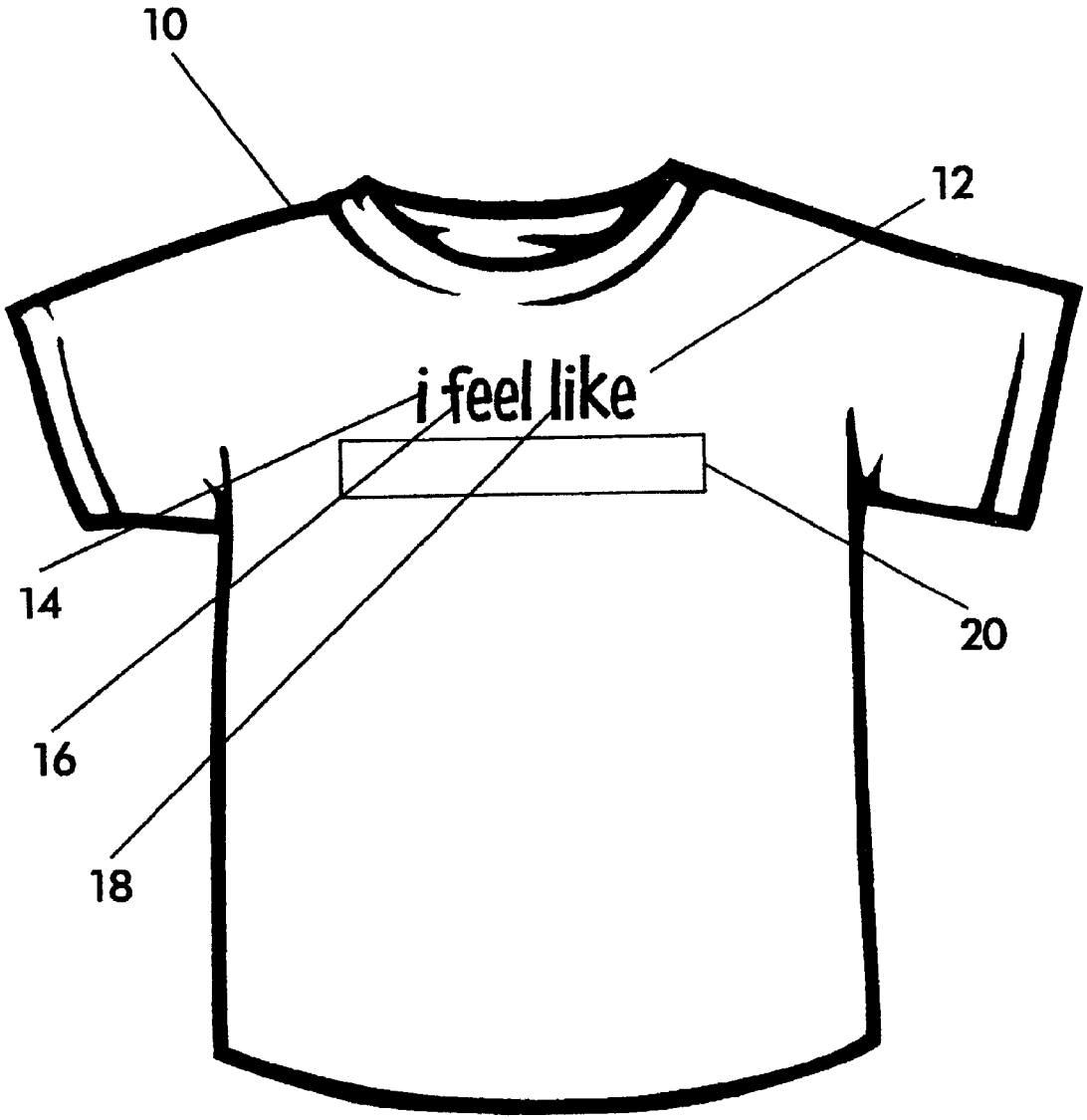
FIG. 1 is a perspective view of a tee shirt in accordance with the present invention showing a first, pre-printed indicia thereon and the hook-and-pile strip adapted for accommodation of a selectable second indicia.

With regard to the front elevational view of FIG. 1, an article of clothing, such as a tee shirt 10, may been seen to include a pre-printed sentence fragment 12 comprising an indicia which, typically, would include a noun 14, a verb 16, and a preposition 18, such that the object of the prepositional phrase, which is itself an object of a transitive verb such as said verb 16, is pre-printed upon the tee shirt 10.

Figure 2:
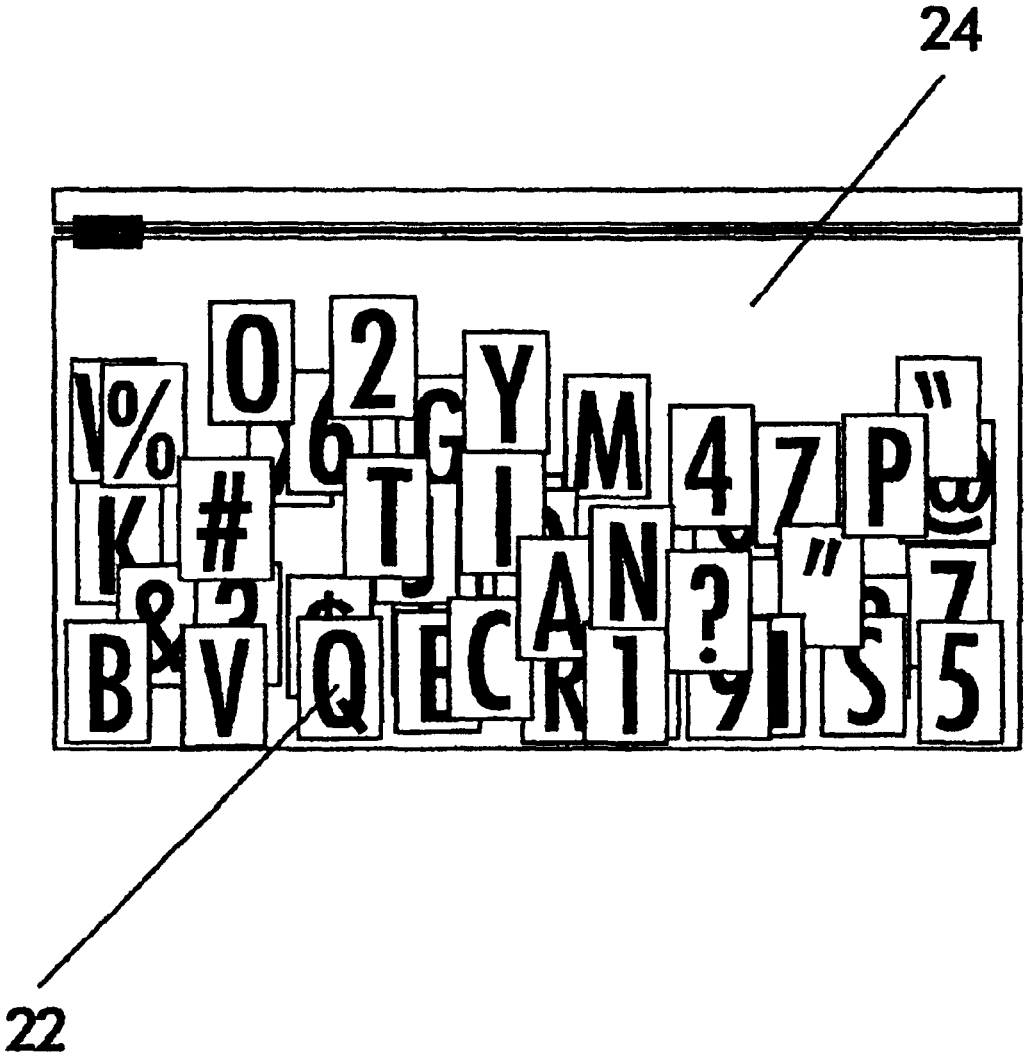
FIG. 2 is a perspective view of a bag, packet, or enclosure containing separate letters each having hook-and-pile backing which is used to form the second indicia associated with the garment.
Figure 3:
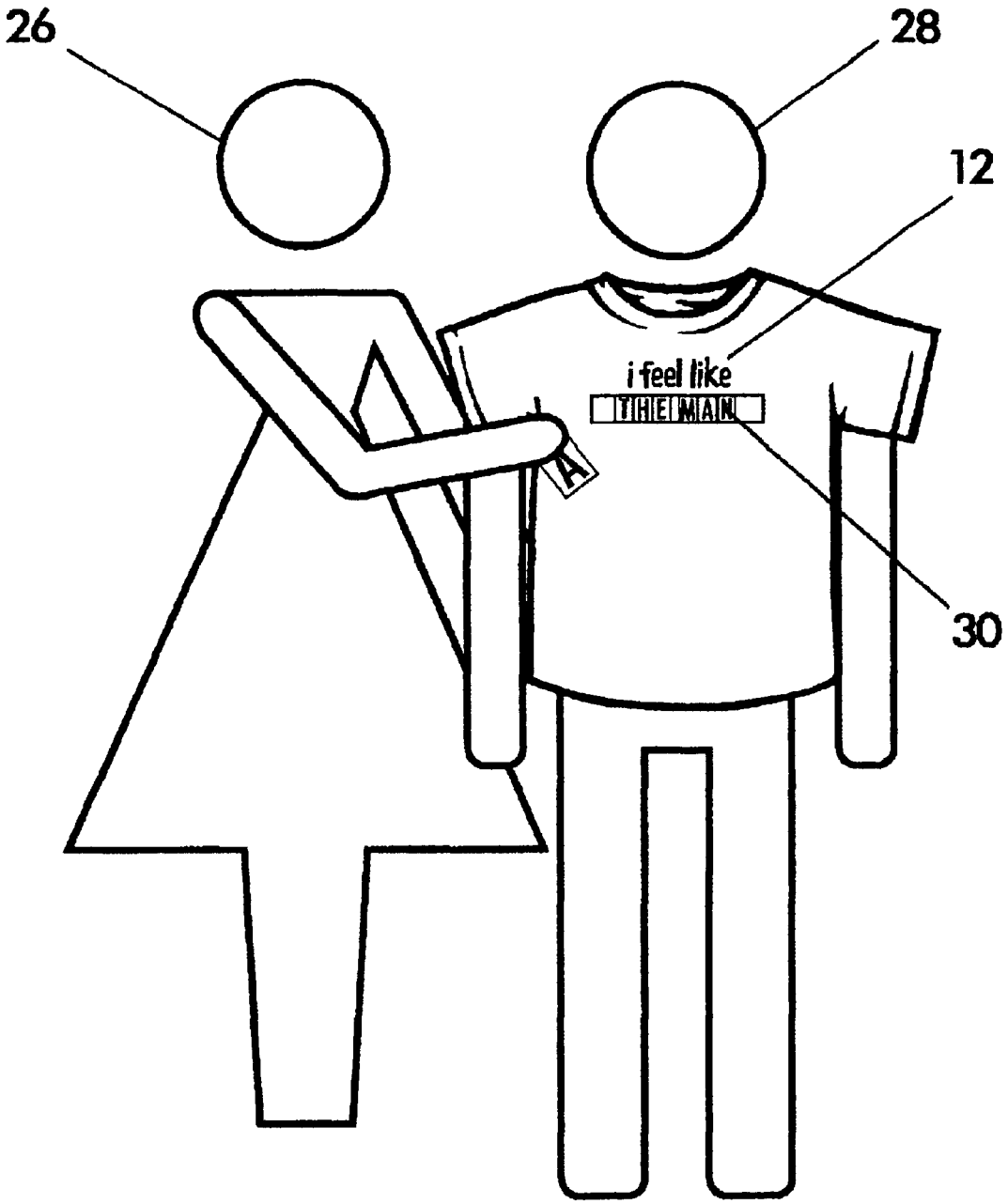
FIG. 3 is an operational view showing the placement of the letters FIG. 2 onto the shirt of FIG. 1.

Positioned therebeneath is a strip 20 of hook-and-pile material having sufficient length to accommodate a plurality of discrete letters of the alphabet, and punctuation marks such as quotes, question marks and symbols. Letters 22 proportioned for adherence to strip 20 are shown in pocket 24 of FIG. 2. Such a bag or pouch will contain a multiplicity of separate letters, each of which exhibit a vertical dimension generally related to the vertical height of said strip 20. Further, each of said letters 22 is provided with a hook-and-pile backing such that, upon the application of pressure, letters 22 will adhere to the part of strip 20 onto which they are placed. This process is more particularly shown in FIG. 3 which indicates the manner in which a friend 26 or one engaging in interactive use 28 may press upon strip 20 the letters which he/she desires to place thereon.

Conversely, user 28 may, either before or after donning the tee shirt (or other garment) 10 remove from packet 24 those letters 22 necessary to form the object of preposition 18 and, thereby, as above noted, the object of the entire sentence fragment 12.

Figure 4:
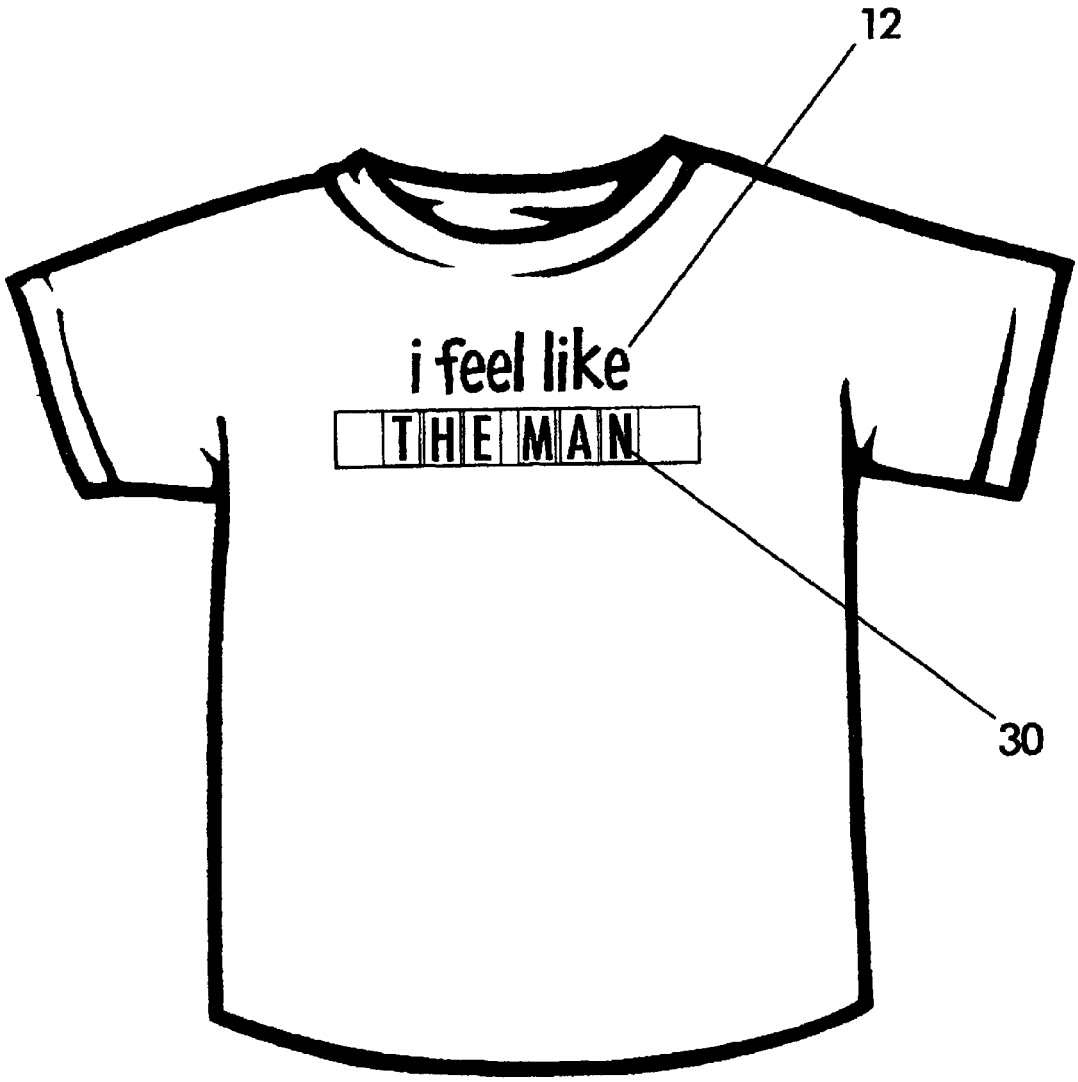
FIG. 4 is a perspective view showing the appearance of the interactive shirt after the second indicia have been adhered thereto.
Figure 5:
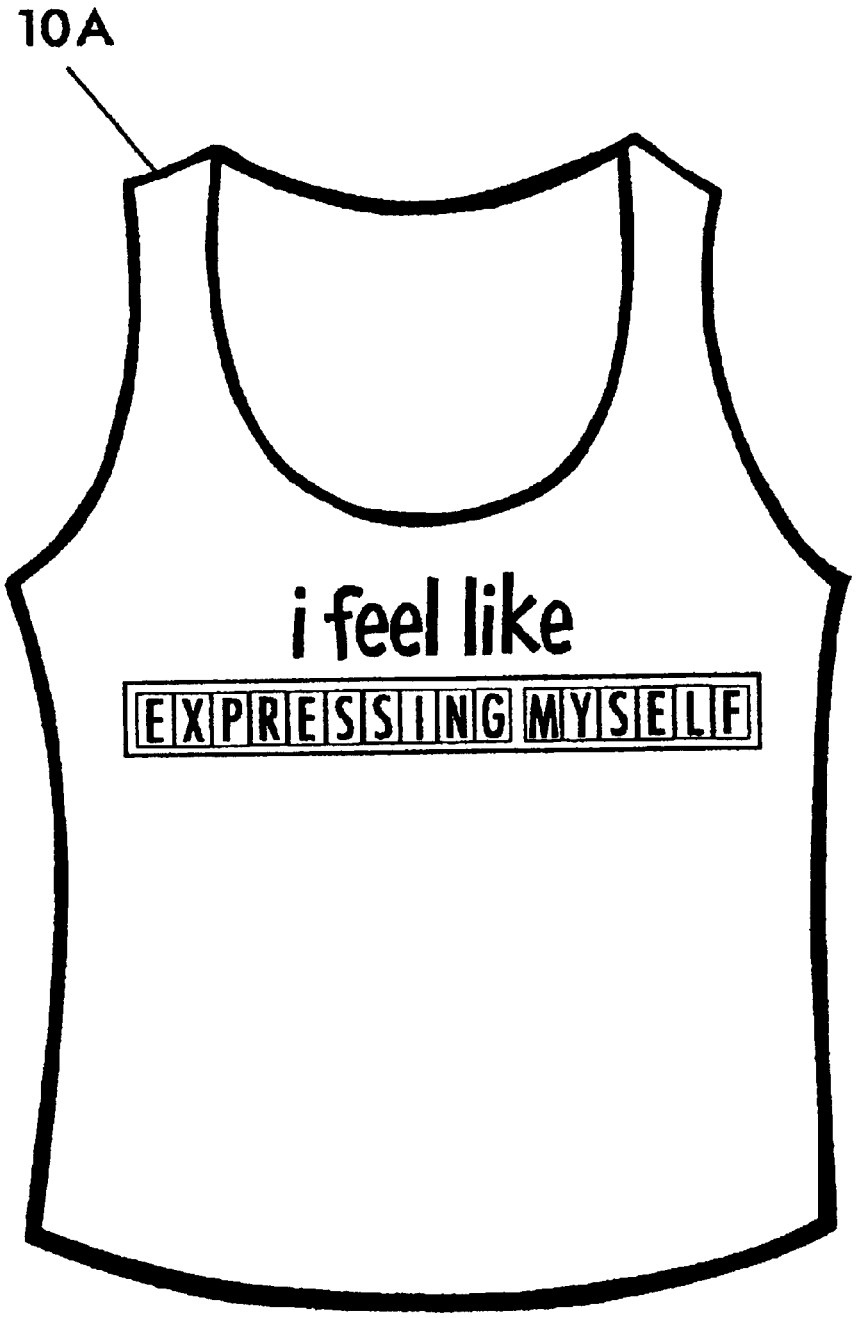
FIG. 5 is an illustration of another type of shirt upon which the invention may be used.
Figure 6:
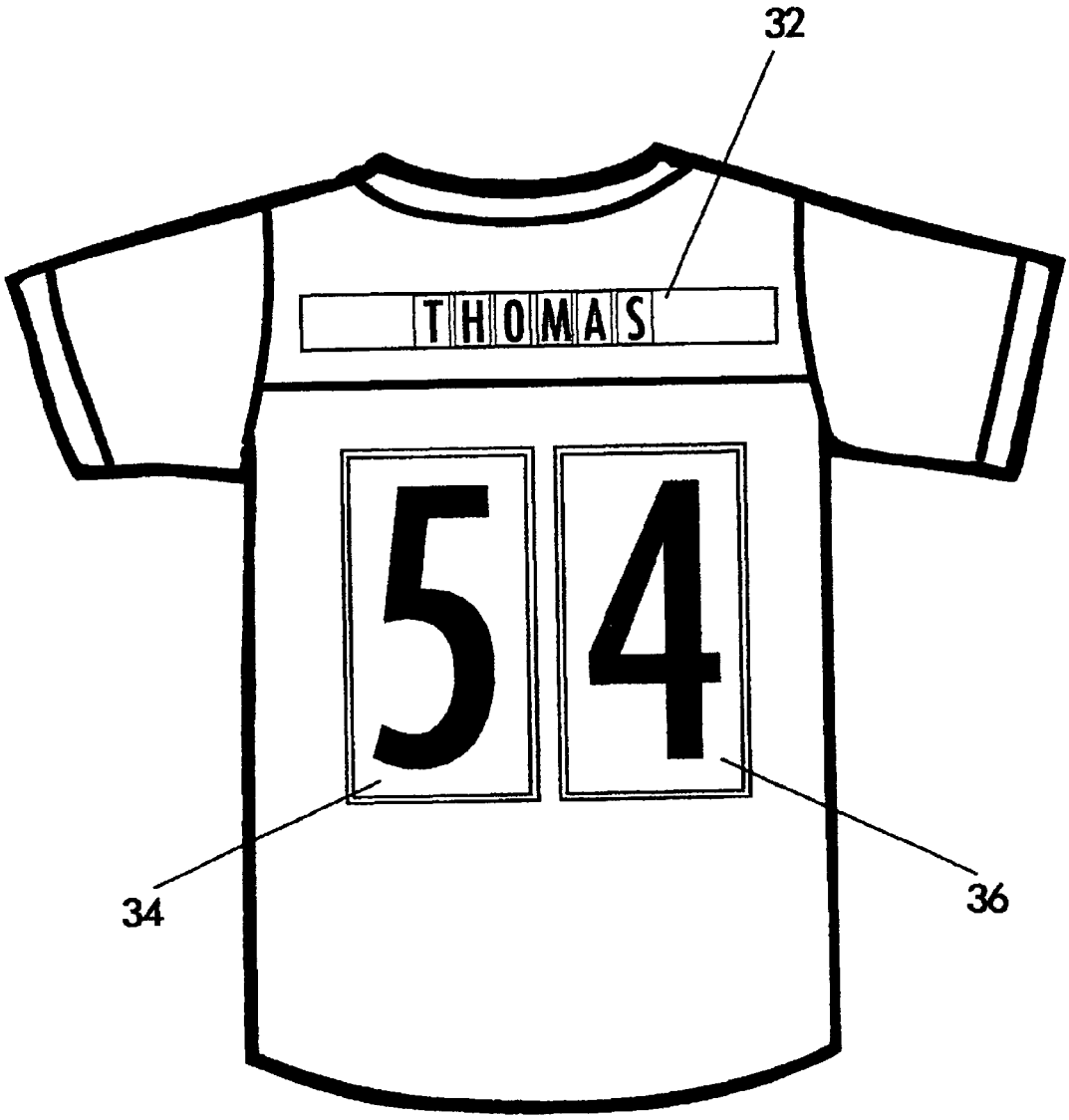
FIG. 6 shows another embodiment of the invention.

Shown in FIG. 4 is one result of this exercise in which a phrase 30 has, through the uses of letters 22, been added as the object of the prepositional phrase starting with preposition 18. In this fashion, the individual user 28 himself or, in interactive fashion in the nature of an entertainment system involving a second party 26, may provide an article of clothing through which the mood or wishes of the user or one interactive therewith can be expressed through the addition of a second indicia comprising said phrase 30.

It is to be understood that the removable/replaceable object of the sentence fragment 12 may also comprise an individual word or several words to thereby form a phrase such as phrase 30 shown in FIG. 4. Thereby, the letters 22 may be replaced by complete words within packet 24, or combinations of individual letters or phrases may be provided within the packet.

It should be further appreciated that the above principles may be applied to any article of clothing and, as well, to fashion accessories such as purses, handbag or the like. As well, any of the letters, words, phrases or the like referenced above may be expressed in any language.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

I claim:

1. An apparel-related entertainment system comprising:

(a) an article of clothing having pre-printed thereon a first indicia comprising a sentence segment including a noun, a verb, and a preposition and, therebeneath, a strip of hook-and-pile material; and (b) an enclosure for holding letters of the alphabet, each letter provided on a surface having a backing comprising a hook-and-pile material, each surface proportioned for press-fittable placement upon and within said strip on said article of clothing to, when positioned thereon, form a second indicia comprising an object or object phrases of said preposition to thereby complete a sentence including said sentence fragment of said first indicia.

2. The system as recited in claim 1, in which said article of clothing comprises a fashion accessory.

3. The system as recited in claim 1, in which said enclosure is transparent.

4. An apparel-related entertainment system comprising:

(a) an article of clothing having pre-printed thereon a first indicia comprising a sentence segment including a noun, a verb, and a preposition and, therebeneath, a strip of hook-and-pile material; and (b) an enclosure for holding words or phrases, each provided on a surface having a backing comprising a hook-and-pile material, each surface proportioned for press-fittable placement upon and within said strip on said article of clothing to, when positioned upon said strip, form a second indicia comprising an object or object phrases of said preposition to thereby complete a sentence including said sentence fragment of said first indicia.

5. The system as recited in claim 4, in which said article of clothing comprises a fashion accessory.

6. The system as recited in claim 4, in which said enclosure is transparent.

* * * * *